US009593469B2

(12) United States Patent
Taylor et al.

(10) Patent No.: US 9,593,469 B2
(45) Date of Patent: Mar. 14, 2017

(54) SYSTEM AND METHOD FOR CONTROLLING A WORK VEHICLE BASED ON A MONITORED TIP CONDITION OF THE VEHICLE

(71) Applicant: CNH Industrial America, LLC, New Holland, PA (US)

(72) Inventors: Lance Taylor, Wichita, KS (US); Timothy Newlin, Wichita, KS (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/521,544

(22) Filed: Oct. 23, 2014

(65) Prior Publication Data

US 2015/0176253 A1 Jun. 25, 2015

Related U.S. Application Data

(60) Provisional application No. 61/918,734, filed on Dec. 20, 2013.

(51) Int. Cl.
*E02F 9/24* (2006.01)
*E02F 9/20* (2006.01)
(Continued)

(52) U.S. Cl.
CPC ..... *E02F 9/265* (2013.01); *B66F 17/003* (2013.01); *E02F 3/3414* (2013.01);
(Continued)

(58) Field of Classification Search
CPC ..... E02F 3/3414; E02F 3/3417; E02F 9/265; E02F 9/2025; E02F 9/24; E02F 9/2033; B66F 17/003; B66F 9/0755
(Continued)

(56) References Cited

U.S. PATENT DOCUMENTS 4,866,641 A 9/1989 Nielsen et al.
5,854,988 A * 12/1998 Davidson ..... E02F 9/26 37/414
(Continued)

FOREIGN PATENT DOCUMENTS

EP 1813569 A1 8/2007
EP 2511677 A1 10/2012
EP 2578757 A1 4/2013

OTHER PUBLICATIONS

EP14199127, European Search Report and Written Opinion, mailed Nov. 9, 2015, 13 pages.
(Continued)

*Primary Examiner* — Nga X Nguyen
(74) *Attorney, Agent, or Firm* — Peter K. Zacharias; Patrick M. Sheldrake

(57) ABSTRACT

A method for controlling a work vehicle based on a monitored tip condition of the work vehicle may generally include determining, with a computing device, a combined center of gravity for the work vehicle based at least in part on an external load applied to a loader arm of the work vehicle, determining a tip-related state of the work vehicle based on a location of the combined center of gravity relative to a pivot point defined between a tire of the work vehicle and a driving surface for the work vehicle and automatically performing a corrective action to counteract vehicle tipping when it is determined that the work vehicle is in a tipping state.

16 Claims, 7 Drawing Sheets

(51) Int. Cl.
*E02F 3/34* (2006.01)
*E02F 9/26* (2006.01)
*B66F 17/00* (2006.01)

(52) U.S. Cl.
CPC ..... *E02F 3/3417* (2013.01); *E02F 9/2025* (2013.01); *E02F 9/24* (2013.01)

(58) Field of Classification Search
USPC ..... 701/50, 33.9, 33.8, 70
See application file for complete search history.

(56) References Cited

U.S. PATENT DOCUMENTS

| | | | |
|---|---|---|---|
| 6,076,029 | A | 6/2000 | Watanabe et al. |
| 6,246,939 | B1 | 6/2001 | Nozawa |
| 6,470,251 | B1 | 10/2002 | Enix |
| 6,634,445 | B2 | 10/2003 | Dix et al. |
| 6,650,985 | B2 | 11/2003 | Lin et al. |
| 6,735,889 | B1 | 5/2004 | Berger et al. |
| 6,766,236 | B1 | 7/2004 | Lamela et al. |
| 6,837,319 | B2 | 1/2005 | Dvorak et al. |
| 7,079,931 | B2 | 7/2006 | Sahm et al. |
| 7,264,068 | B2 | 9/2007 | Priepke |
| 7,496,441 | B2 | 2/2009 | Brandt et al. |
| 7,881,845 | B2 | 2/2011 | Nichols |
| 8,082,084 | B2 | 12/2011 | Nichols |
| 2010/0204891 | A1 | 8/2010 | Biggerstaff |
| 2014/0121840 | A1* | 5/2014 | Mizuochi ..... G05B 15/02 700/275 |

OTHER PUBLICATIONS

Harris, Tom: "How Segways Work," HowStuffWorks.com, available at http://science.howstuffworkscom/transport/engines-equipment/ginger.htm/printable, published Dec. 3, 2001, last accessed Sep. 19, 2016.

DEKA iBot, available at http://www.dekaresearch.com/ibot.shtml, undated.

* cited by examiner

SYSTEM AND METHOD FOR CONTROLLING A WORK VEHICLE BASED ON A MONITORED TIP CONDITION OF THE VEHICLE

FIELD OF THE INVENTION

The present subject matter relates generally to work vehicles and, more particularly, to a system and method for controlling a work vehicle based on a monitored tip condition of the vehicle.

BACKGROUND OF THE INVENTION

Work vehicles having loader arms, such as skid steer loaders, telescopic handlers, wheel loaders, backhoe loaders, forklifts, compact track loaders and the like, are a mainstay of construction work and industry. For example, skid steer loaders typically include a loader arm pivotally coupled to the vehicle's chassis that can be raised and lowered at the operator's command. The loader arm typically has an implement attached to its end, thereby allowing the implement to be moved relative to the ground as the loader arm is raised and lowered. For example, a bucket is often coupled to the loader arm, which allows the skid steer loader to be used to carry supplies or particulate matter, such as gravel, sand, or dirt, around a worksite.

One of the disadvantages of traditional skid steer loaders and other work vehicles having loader arms is their potential lack of stability when a loaded implement is raised, particularly when the load is extremely heavy. Such a condition leads to instability and potential tipping of the vehicle off its wheels. Unfortunately, the control systems currently available for such vehicles lack the capability of accurately monitoring a vehicle's tipping state or status and, thus, are not able to provide the operator with an adequate warning that tipping is imminent. In addition, current control systems lack a control strategy for controlling the operation of a work vehicle at the point at which the vehicle actually begins to tip over.

Accordingly, an improved system and method for controlling the operation of a work vehicle based on a monitored tip condition of the vehicle would be welcomed in the art.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for controlling a work vehicle based on a monitored tip condition of the work vehicle. The method may generally include determining, with a computing device, a combined center of gravity for the work vehicle based at least in part on an external load applied to a loader arm of the work vehicle and determining a tip-related state of the work vehicle based on a location of the combined center of gravity relative to a pivot point defined between a tire of the work vehicle and a driving surface for the work vehicle, wherein the work vehicle is in a non-tipping state when the combined center of gravity is located on a vehicle side of the pivot point and in a tipping state when the combined center of gravity is located on a non-vehicle side of the pivot point. In addition, the method may include automatically performing a corrective action to counteract vehicle tipping when it is determined that the work vehicle is in the tipping state.

In another aspect, the present subject matter is directed to a method for controlling a work vehicle based on a monitored tip condition of the work vehicle. The method may generally include determining, with a computing device, a combined center of gravity for the work vehicle based at least in part on an external load applied to a loader arm of the work vehicle and determining a tip-related state of the work vehicle based on a location of the combined center of gravity relative to a pivot point defined between a tire of the work vehicle and a driving surface for the work vehicle, wherein the work vehicle is in a non-tipping state when the combined center of gravity is located on a vehicle side of the pivot point and in a tipping state when the combined center of gravity is located on a non-vehicle side of the pivot point. In addition, the method may include calculating a tip percentage for the work vehicle when it is determined that the work vehicle is in the non-tipping state and transmitting a signal to a display device of the work vehicle for visually displaying the tip percentage.

In a further aspect, the present subject matter is directed to a system for controlling a work vehicle based on a monitored tip condition of the work vehicle. The system may generally include a computing device including a processor and associated memory. The memory may store computer-readable instructions that, when implemented by the processor, configure the computing device to determine a combined center of gravity for the work vehicle based at least in part on an external load applied to a loader arm of the work vehicle and determine a tip-related state of the work vehicle based on a location of the combined center of gravity relative to a pivot point defined between a tire of the work vehicle and a driving surface for the work vehicle, wherein the work vehicle is in a non-tipping state when the combined center of gravity is located on a vehicle side of the pivot point and in a tipping state when the combined center of gravity is located on a non-vehicle side of the pivot point. In addition, the computing device may be configured to automatically perform a corrective action to counteract vehicle tipping when it is determined that the work vehicle is in the tipping state.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
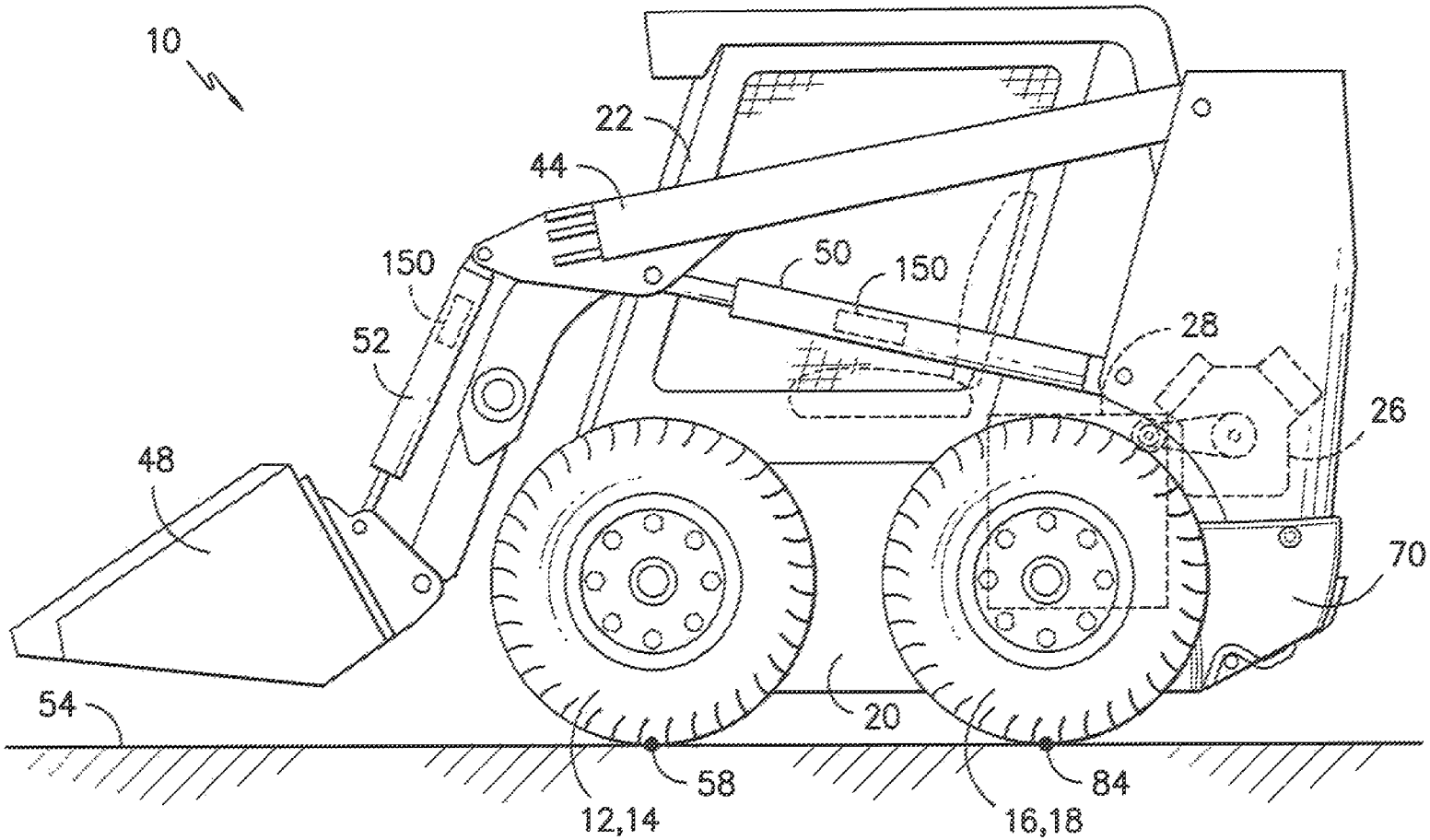
FIG. 1 illustrates a side view of one embodiment of a work vehicle in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system and method for controlling a work vehicle based on a monitored tip condition of the vehicle. Specifically, in several embodiments, a controller of the work vehicle may be configured to monitor various tip-related parameters, such as a load weight of an external load applied to the work vehicle, a position of the external load relative to a driving surface of the work vehicle and an angle of inclination of the work vehicle, in order to determine a combined center of gravity for the work vehicle that takes into account both the configuration of the vehicle in an unloaded state and the impact of external loads acting on the work vehicle. The combined center of gravity for the work vehicle may then be used to determine a tip-related state of the vehicle, namely whether the work vehicle is a stable, non-tipping state or whether the work vehicle is actively tipping over such that the vehicle is in a tipping state.

Additionally, based on the tip-related state of the work vehicle, the controller may be configured to perform one or more actions. Specifically, in several embodiments, when the work vehicle is in a stable, non-tipping state, the controller may be configured to provide a tip indicator associated with the likelihood that the work vehicle will tip. For instance, the tip indicator may correspond to an operator warning (e.g., a warning light) designed to warn the operator that tipping is imminent or the tip indicator may correspond to a visual readout of a tip percentage for the work vehicle (i.e., a percentage that increases as the work vehicle gets closer to transitioning to a tipping state). Moreover, when the work vehicle is in a tipping state (i.e., such that the vehicle has begun to tip), the controller may be configured to automatically perform a corrective action designed to counteract or reverse the tipping of the vehicle. For example, as will be described below, the controller may be configured to lower the position of its loaded implement and/or adjust the speed and/or acceleration of the work vehicle in the tipping direction in an attempt to counteract tipping.

Figure 2:
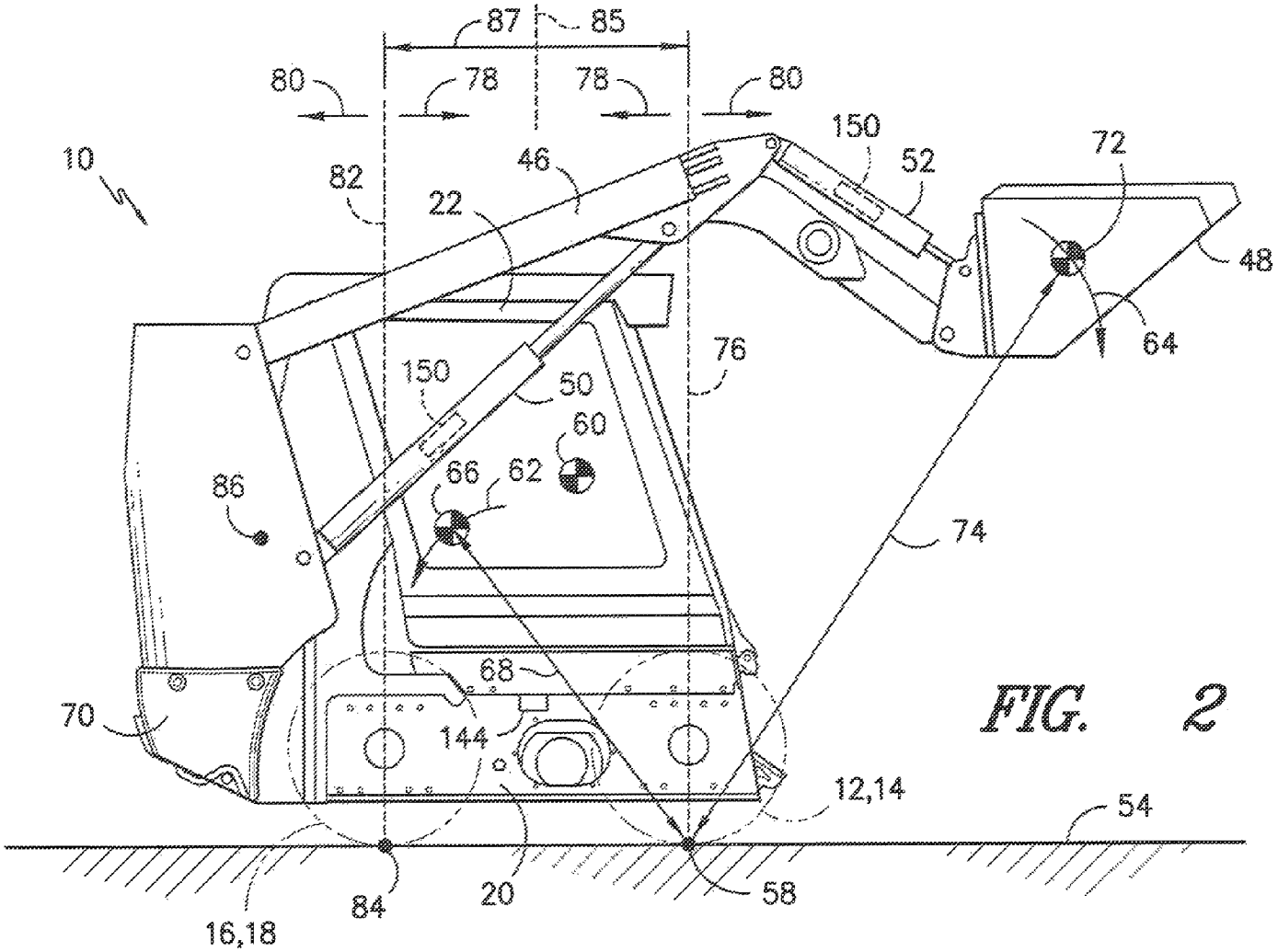
FIG. 2 illustrates a side view of the opposite side of the work vehicle shown in FIG. 1, particularly illustrating various components of the work vehicle removed to show the chassis and various other structural components of the work vehicle.
Figure 3:
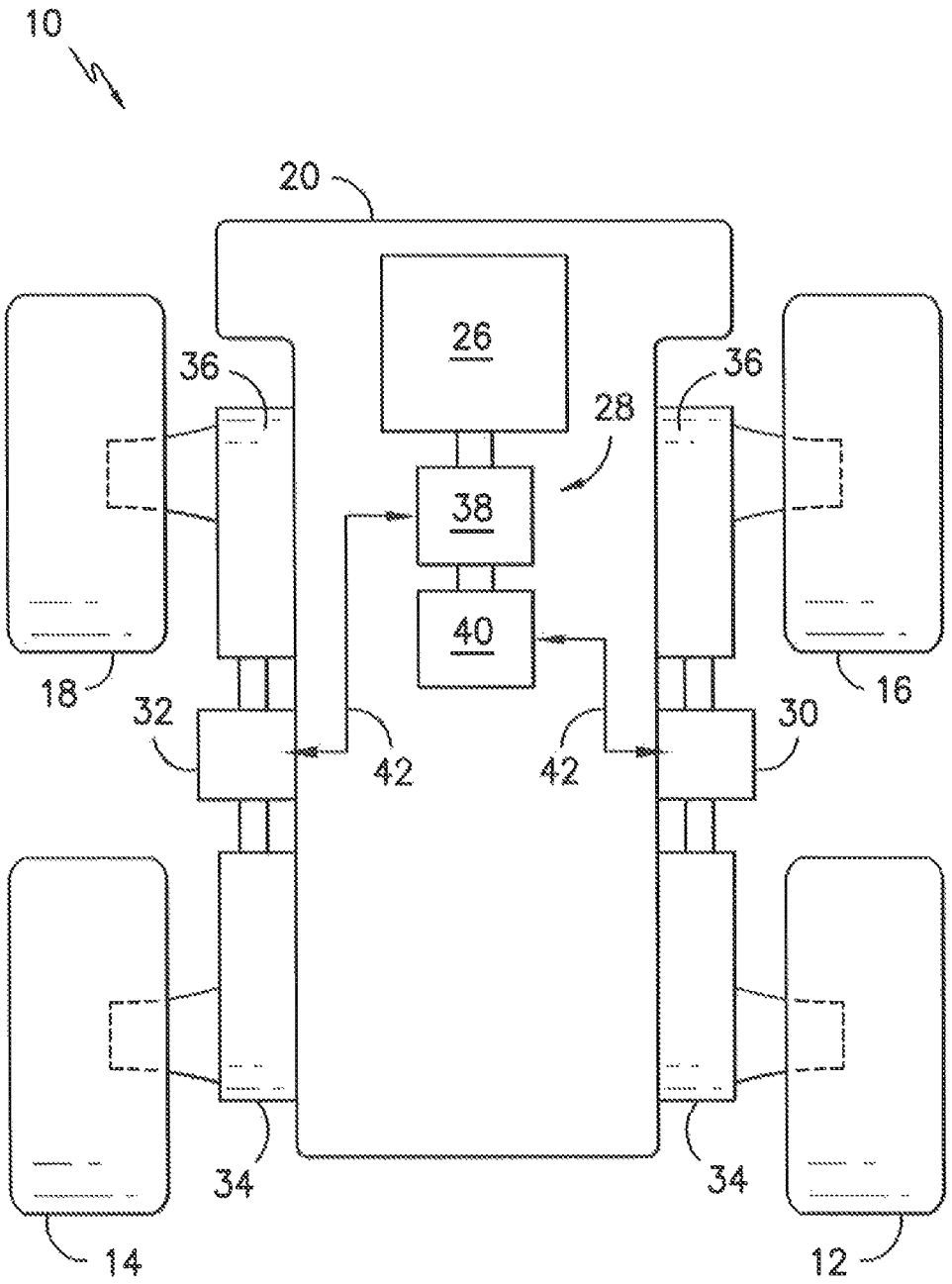
FIG. 3 illustrates a schematic, top view of various components of the work vehicle shown in FIG. 1.
Figure 4:
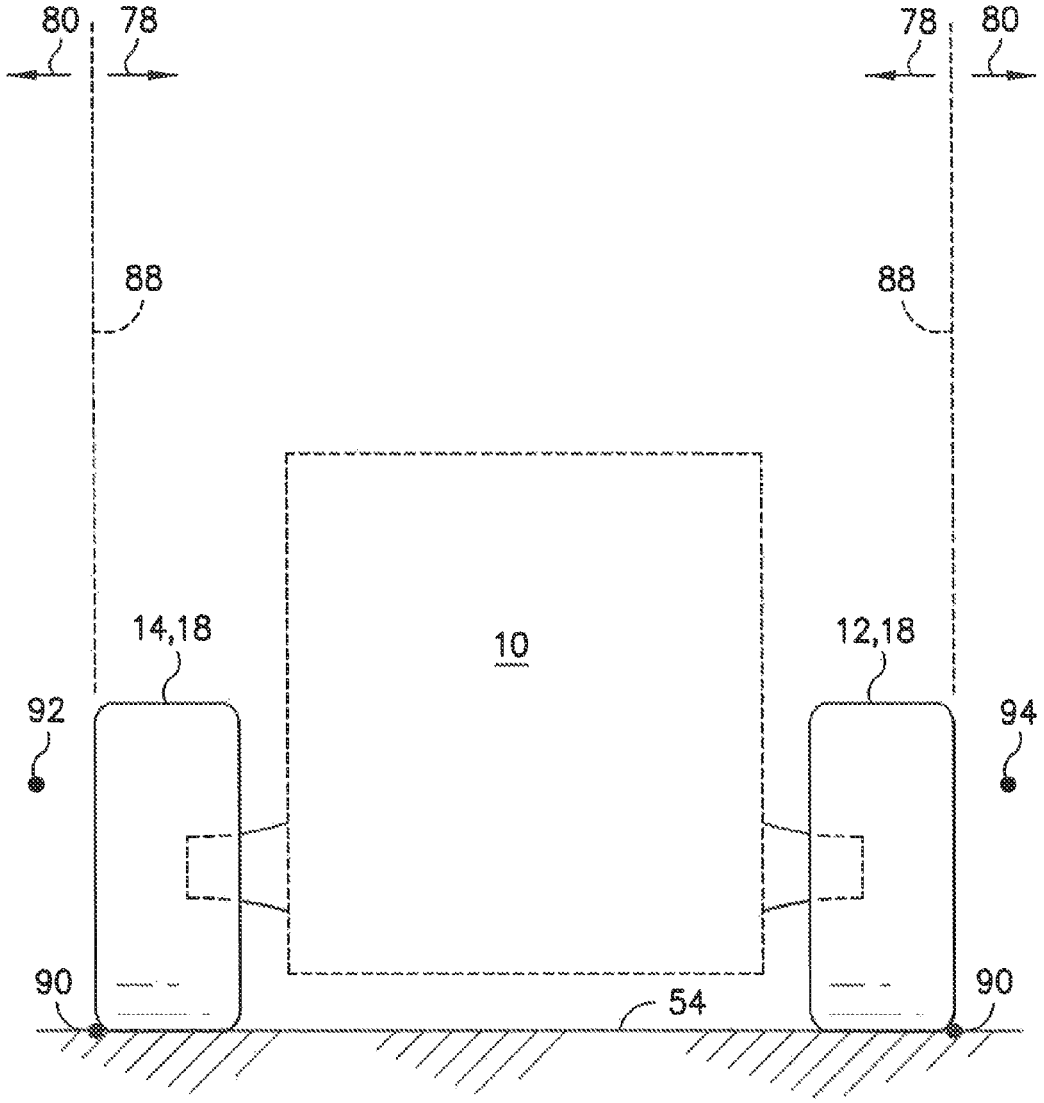
FIG. 4 illustrates a schematic, rear view of the work vehicle shown in FIG. 1.

Referring now to the drawings, FIGS. 1-4 illustrate different views of one embodiment of a work vehicle 10. Specifically, FIG. 1 illustrates a side view of the work vehicle 10 and FIG. 2 illustrates the opposite side of the work vehicle 10 shown in FIG. 1, particularly illustrating the work vehicle 10 with various components removed to show the chassis and various other structural components of the vehicle 10. FIG. 3 illustrates a schematic view of various components of the work vehicle 10 shown in FIG. 1. Additionally, FIG. 4 illustrates a schematic rear view of the work vehicle shown in FIG. 1.

In the illustrated embodiment, the work vehicle 10 is configured as a skid steer loader. However, in other embodiments, the work vehicle 10 may be configured as any other suitable work vehicle known in the art, such as various agricultural vehicles, earth-moving vehicles, road vehicles, all-terrain vehicles, off-road vehicles and/or the like, including various other work vehicles including loader arms (e.g., telescopic handlers, wheel loaders, backhoe loaders, fork-lifts, compact track loaders and/or the like).

As shown, the work vehicle 10 includes a pair of front wheels 12, 14, a pair of rear wheels 16, 18 and a chassis 20 coupled to and supported by the wheels 12, 14, 16, 18. An operator's cab 22 may be supported by a portion of the chassis 20 and may house various input devices for permitting an operator to control the operation of the work vehicle 10. In addition, the work vehicle 10 may include an engine 26 and a hydrostatic drive unit 28 coupled to or otherwise supported by the chassis 20.

As particularly shown in FIG. 3, the hydrostatic drive unit 28 of the work vehicle 10 may include a pair of hydraulic drive motors (e.g., a first hydraulic drive motor 30 and a second drive hydraulic motor 32), with each hydraulic motor 30, 32 being configured to drive a pair of wheels 12, 14, 16, 18. For example, the first hydraulic drive motor 30 may be configured to drive the left-side wheels 12, 16 via front and rear axles 34, 36, respectively. Similarly, the second hydraulic drive motor 32 may be configured to drive the right-side wheels 14, 18 via front and rear axles 34, 36, respectively. Alternatively, the motors 30, 32 may be configured to drive the wheels 12, 14, 16, 18 using any other suitable means known in the art. For instance, in another embodiment, the drive motors 30, 32 may be coupled to the wheels via a suitable sprocket/chain arrangement (not shown) as opposed to the axles 34, 36 shown in FIG. 3.

Additionally, the hydrostatic drive unit 28 may include a pair of hydraulic pumps (e.g., a first hydraulic pump 38 and a second hydraulic pump 40) driven by the engine 26, which may, in turn, supply pressurized fluid to the motors. For example, as shown in FIG. 3, the first hydraulic pump 38 may be fluidly connected to the first drive motor 30 (e.g., via a suitable hydraulic hose or other fluid coupling 42) while the second hydraulic pump 40 may be fluidly connected to the second drive motor 32 (e.g., via a suitable hydraulic hose or other fluid coupling 42). As such, by individually controlling the operation of each pump 38, 40, the speed of the left-side wheels 12, 16 may be regulated independent of the right-side wheels 14, 18.

Moreover, as shown in FIGS. 1 and 2, the work vehicle 10 may also include a pair of loader arms 44, 46 (e.g., a first loader arm 44 (FIG. 1) and a second loader arm 46 (FIG. 2)) coupled between the chassis 20 and a suitable implement 48 (e.g., a bucket, fork, blade and/or the like). Hydraulic cylinders 50, 52 may also be coupled between the chassis 20 and the loader arms 44, 46 and between the loader arms 44, 46 and the implement 48 to allow the implement 48 to be raised/lowered and/or pivoted relative to a driving surface 54 of the work vehicle 10. For example, a lift cylinder 50 may be coupled between the chassis 20 and each loader arm 44, 46 for raising and lowering the loader arms 44, 46, thereby controlling a height of the implement 48 relative to the driving surface 54. Additionally, a tilt cylinder 52 may be coupled between each loader arm 44, 46 and the implement 48 for pivoting the implement 48 relative to the loader arms 44, 45, thereby controlling the pivot angle of the implement 48 relative to the driving surface 54.

Due to its configuration, the work vehicle 10 may be subject to tipping during operation based on one or more tip-related parameters associated with the vehicle 10, such as a height and/or a load weight of any external loads applied to the loader arms 44, 46 via the implement 48 and/or an angle of inclination the work vehicle 10. For example, when the implement 48 is being raised while loaded (e.g., when the bucket is full), the work vehicle 10 may become unstable and may be subject to tipping forward about a pivot point 58 defined at the point of contact between the front tires 12, 14 and the driving surface 54. Such instability may be further increased when the driving surface 54 is sloped downwardly, thereby increasing the likelihood of the work vehicle 10 tipping forward.

As particularly shown in FIG. 2, to determine the likelihood of the work vehicle 10 transitioning from a stable, non-tipping state to a tipping state, a combined center of gravity 60 may be identified for the work vehicle 10 based on a vehicle moment arm 62 of the work vehicle 10 and a load moment arm 64 associated with any external loads applied to the loader arms 44, 46 via the implement 48. In general, the vehicle moment arm 62 may be calculated as a function of an unloaded weight of the work vehicle 10 as applied through a vehicle center of gravity 66. Specifically, the vehicle moment arm 62 may be equal to the product of the unloaded vehicle weight times a distance 68 defined between the location of the vehicle center of gravity 66 and the pivot point 58. As used herein, the vehicle center of gravity 66 may generally correspond to the center of gravity of the unloaded work vehicle 10 and, thus, may take into account the weight distribution of the various vehicle components when in an unloaded state, including any counterweights mounted on or within vehicle 10. For example, as shown in the illustrated embodiment, a counterweight 70 may often be coupled to the bottom, rear portion of the chassis 20 to adjust the location of the vehicle center of gravity 66 in the direction of the counterweight 70.

Additionally, the load moment arm 64 may be calculated as a function of the load weight of any external loads applied through the implement 48 at a load center of gravity 72 associated with such load(s). Specifically, the load moment arm 64 may be equal to the product of the load weight times a distance 74 defined between the location of the load center of gravity 72 and the pivot point 58. As used herein, the load center of gravity 72 may generally correspond to the center of gravity of the external load(s) applied through the implement 48. For instance, as shown in FIG. 2, when the implement 48 is loaded, the load center of gravity 72 may be contained within or positioned adjacent to a portion the implement 48 (e.g., at the center of the bucket).

It should be appreciated that the vehicle center of gravity 66 and the associated vehicle moment arm 62 may generally correspond to known values that may be determined based on the overall configuration of the work vehicle 10. In contrast, the load center of gravity 72 and the associated load moment arm 64 may vary significantly depending on the overall weight of the external load(s) as well as the position to which the external load(s) has been raised above the vehicle's driving surface 54. As will be described below, a controller of the work vehicle 10 may be communicatively coupled to one or more suitable sensors to allow the controller to monitor both the load weight and the position of the external load(s).

As shown in FIG. 2, the vehicle and load moment arms 62, 64 are generally applied in opposed directions relative to the work vehicle 10. Specifically, the vehicle moment arm 62 acts to induce rotation of the work vehicle 10 about the pivot point 58 in a direction that maintains the rear tires 16, 18 in contact with the driving surface 48 (e.g., in the counter-clockwise direction) and, thus, serves to counteract vehicle tipping. In contrast, the load moment arm 64 acts to induce rotation of the work vehicle 10 about the pivot point 58 in the opposite, tipping direction (e.g., in the clockwise direction). Under most circumstances, the vehicle moment arm 62 exceeds the load moment arm 64 such that the work vehicle 10 is maintained in a stable, non-tipping state. However, in certain instances, the load moment arm 64 may exceed the vehicle moment arm 62, thereby causing the work vehicle 10 to tip about the pivot point 58.

As indicated above, based on the vehicle and load moment arms 62, 64, a combined center of gravity 60 for the work vehicle 10 may be defined that generally corresponds to the vehicle's effective or resultant center of gravity taking into account the combined impact of the moment arms 62, 64 on the vehicle's weight distribution. Thus, in several embodiments, the tip-related state of the work vehicle 10 may be defined as a function of the location of the combined center of gravity 60 relative to a forward tipping plane 76 extending vertically from the pivot point 58. Specifically, when the combined center of gravity 60 is located on a vehicle-side 78 of the forward tipping plane 76 (i.e., when the vehicle moment arm 62 exceeds the load moment arm 64), the vehicle 10 may be in a stable, non-tipping state. However, as the combined center of gravity 60 shifts from the vehicle-side 78 of the forward tipping plane 76 to a non-vehicle side 78 of such plane 76 (i.e., when the load moment arm 64 exceeds the vehicle moment arm 62), the vehicle transitions to a tipping state and, thus, begins to tip or pivot forward relative to the pivot point 58.

It should be appreciated that, in several embodiments, the location of the combined center of gravity 60 relative to the forward tipping plane 76 may be expressed as a tip percentage of the work vehicle 10. For example, in one embodiment, the tip percentage of the work vehicle 10 may be equal to 0% when the combined center of gravity 60 is located at the vehicle center of gravity 66 (i.e., when the work vehicle 10 is unloaded) and 100% when the combined center of gravity 60 is aligned with the forward tipping plane 76 (i.e., when the vehicle moment arm 62 is equal to the load moment arm 64). Thus, as the combined center of gravity 60 moves closer to the forward tipping plane 76 as the load moment arm 64 is increased relative to the vehicle moment arm 62 (e.g., when the implement 48 is loaded and is being raised), the tip percentage may steadily increase. For instance, a tip percentage of 90% may indicate that the work vehicle 10 is close to transitioning from a non-tipping state to a tipping state while a tip percentage of 95% may indicate that the work vehicle 10 is even closer to transitioning to a tipping state. Similarly, a tip percentage of 100% may indicate that the work vehicle 10 is at the threshold of transitioning to a tipping state such that any additional increase in the load moment arm will cause the vehicle 10 to tip.

Additionally, it should be appreciated that, although the present subject matter will generally be described herein with reference to the work vehicle 10 tipping forward, the work vehicle 10 may also be capable of tipping in any other suitable direction when the combined center of gravity 60 for the vehicle 10 is located on a non-vehicle side 78 of one of the vehicle's tipping planes. For instance, as shown in FIG. 2, a backward tipping plane 82 may extend vertically at a corresponding pivot point 84 defined between the rear tires 16, 18 and the driving surface 54. Thus, if the combined center of gravity 60 for the vehicle 10 shifts rearward of such plane 82 (e.g., to point 86), the vehicle 10 may tip backward about the rear pivot points 84. Similarly, as shown in FIG. 4, side tipping planes 88 may extend vertically at corresponding pivot points 90 defined between the tires 12, 14, 16, 18 and the driving surface 48 along each side of the work vehicle 10. Thus, if the combined center of gravity 60 of the vehicle 10 shifts to the left or right of the area defined between such planes 90 (e.g., to point 92 or point 94), the vehicle 10 may tip to one side.

Figure 5:
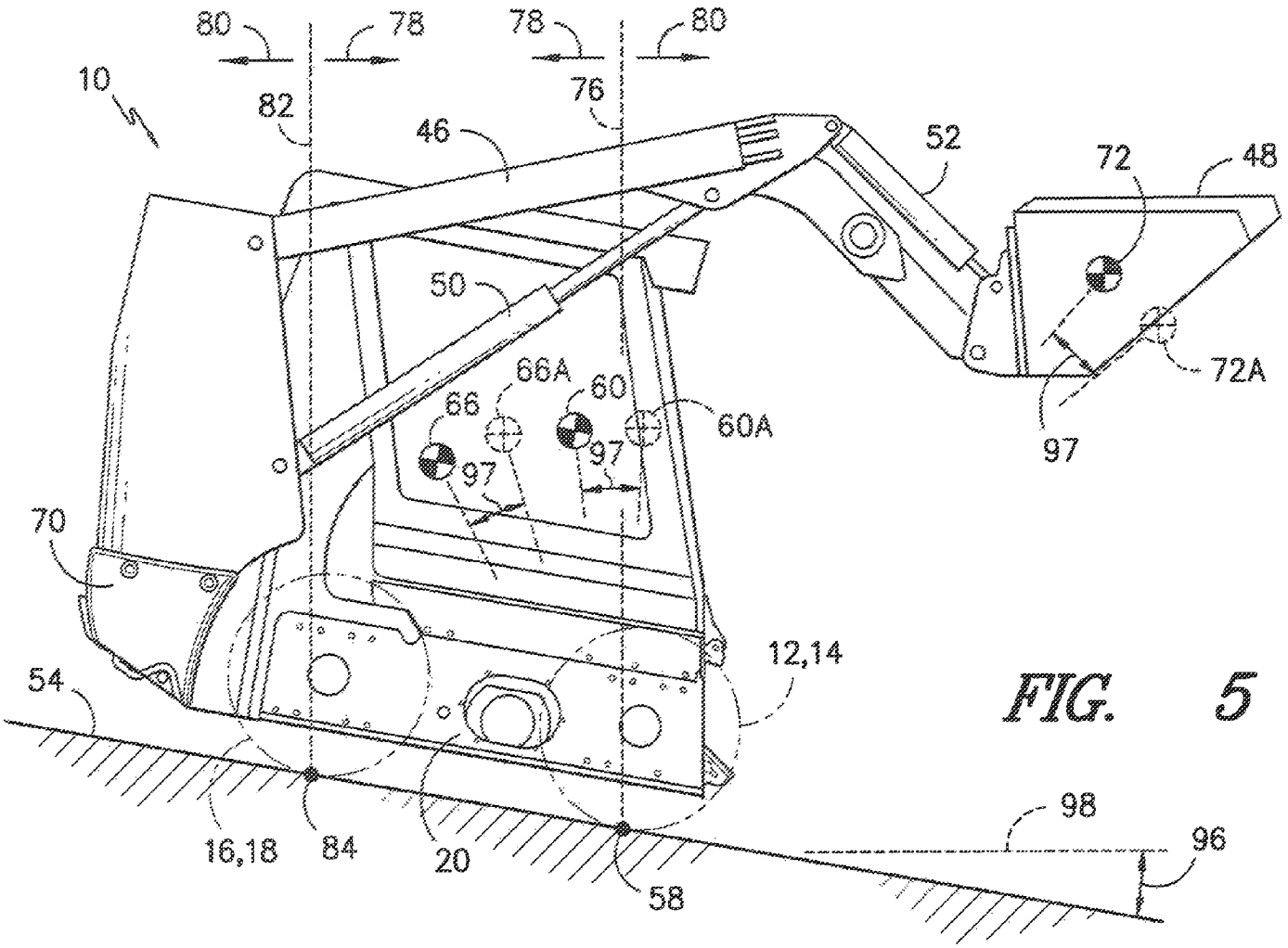
FIG. 5 illustrates another side view of the portion of the work vehicle shown in FIG. 2, particularly illustrating the work vehicle positioned on a sloped driving surface.

As indicated above, it should also be appreciated that an angle of inclination of the work vehicle 10 may also impact the likelihood of the work vehicle 10 tipping. For example, FIG. 5 illustrates the same view of the work vehicle 10 shown in FIG. 2, except that the work vehicle 10 is now positioned on a sloped driving surface 48 such that the vehicle 10 defines an angle of inclination 96 relative to a horizontal reference plane 98. As shown in the illustrated embodiment, the driving surface 48 is sloped downwardly relative to the work vehicle 10 such that the front pivot point 58 is positioned vertically below the rear pivot point 84. As such, the various centers of gravity 60, 66, 72 defined by the work vehicle 10 may be rotated forward about the front pivot point 58 by a shift angle 97 equal to the angle of inclination 96 of the work vehicle 10. Specifically, FIG. 5 illustrates both the location of the centers of gravity 60, 66, 72 from FIG. 2 (i.e., when the work vehicle 10 was located on a flat or horizontal driving surface 48) and the shifted centers of gravity 60A, 66A, 72A due to the sloped driving surface 48. As shown in FIG. 5, due to the angle of inclination 96 of the work vehicle 10, the combined center of gravity 60A has shifted to a location on the non-vehicle side 80 of the forward tipping plane 76. Thus, when moved onto such a sloped surface 54, the work vehicle shown in FIG. 5 would tip forward about the front pivot point 58.

Of course, if the driving surface 48 was instead sloped upwardly (e.g., such that the front pivot point 58 is positioned vertically above the rear pivot point 84), the various centers of gravity 60, 66, 72 may be shifted in the opposite direction, thereby significantly reducing the likelihood of the work vehicle 10 tipping forward but increasing the likelihood of the vehicle 10 tipping backward. It should also be appreciated that the angle of inclination 96 includes not only the angular orientation of the work vehicle 10 within the viewing plane shown in FIG. 5 (i.e., front to back) but also the side-to-side angular orientation of the work vehicle 10. Thus, for example, if the work vehicle 10 is on a driving surface 54 that is sloped side-to-side, the angle of inclination 96 may cause the location of the combined center of gravity 60 to be shifted towards one of the side tipping planes 88, thereby increasing the likelihood that the work vehicle 10 tips over on its side.

Additionally, it should be appreciated that, given the increased likelihood of work vehicles having a loader arm(s) to tip forward, it may be sufficient, in many instances, to simply monitor the location of the combined center of gravity 60 relative to the forward tipping plane 76. However, as indicated above, there may be instances (e.g., on a significantly upward sloped surface) in which the work vehicle 10 may be subject to tipping backward. Thus, in several embodiments, the tip-related state of the work vehicle 10 may be monitored for tipping forward or backwards depending on the location of the combined center of gravity 60 between the forward and backward tipping planes 76, 82. For instance, as shown in FIG. 2, a vertically extending reference plane 85 may be defined at a location that is spaced apart from the forward and backward tipping planes 76, 82 by a horizontal distance that is equal to 50% of a total horizontal distance 85 defined between the planes 76, 82. In such an embodiment, if the combined center of gravity 60 is located between the reference plane 85 and the forward tipping plane 76, the tip-related state of the work vehicle 10 may be monitored with regard to the likelihood of the vehicle 10 tipping forward (i.e., by continuously monitoring the location of the combined center of gravity 60 relative to the forward tipping plane 76). Similarly, if the combined center of gravity 60 is located between the reference plane 85 and the backward tipping plane 82, the tip-related state of the work vehicle 10 may be monitored with regard to the likelihood of the vehicle 10 tipping backwards (i.e., by continuously monitoring the location of the combined center of gravity 60 relative to the backward tipping plane 82).

Figure 6:
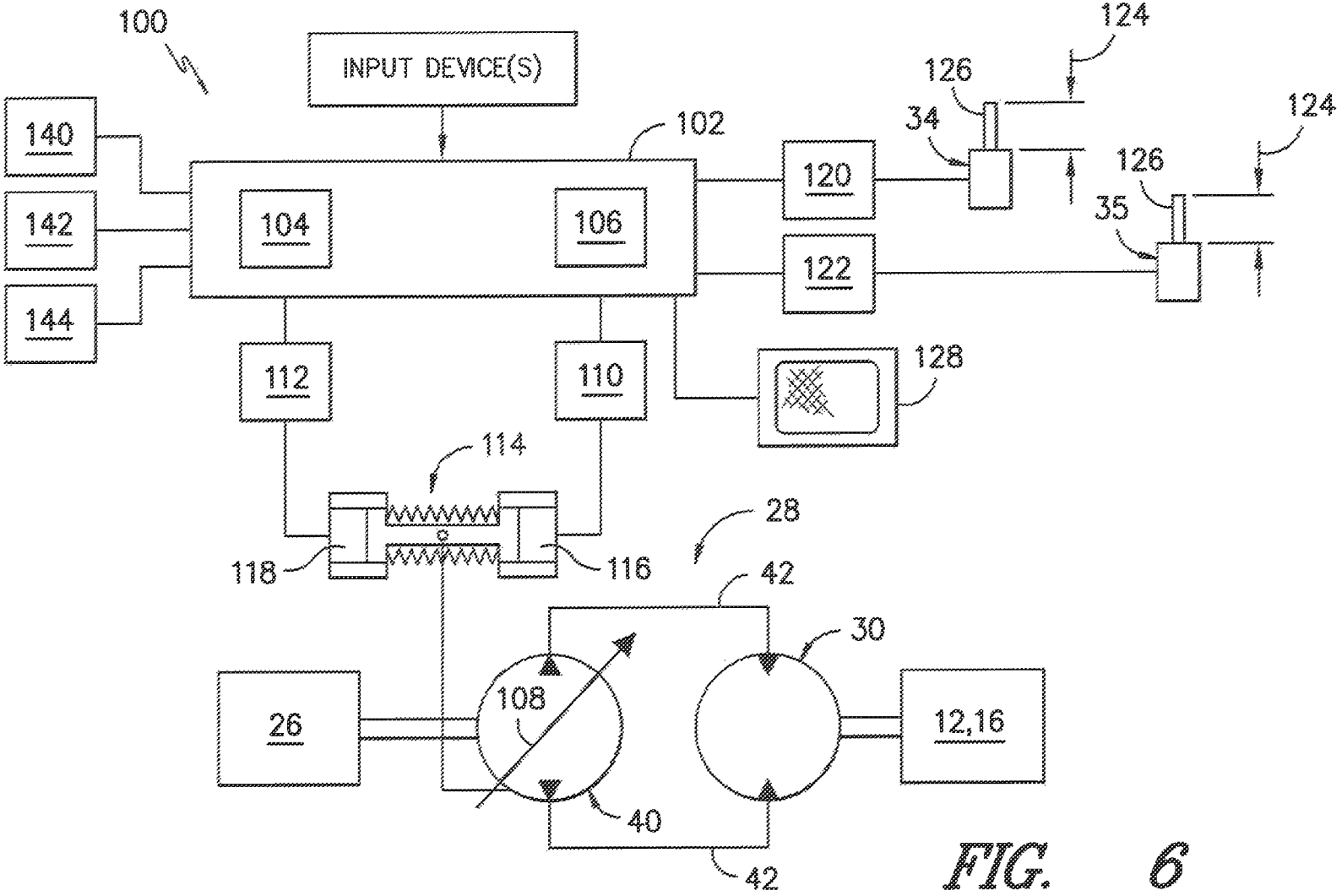
FIG. 6 illustrates a schematic view of one embodiment of a system for controlling a work vehicle based on a monitored tip condition of the vehicle.

Referring now to FIG. 6, one embodiment of a control system 100 suitable for controlling various components of a work vehicle is illustrated in accordance with aspects of the present subject matter. In general, the control system 100 will be described herein with reference to the work vehicle 10 described above with reference to FIGS. 1-5. However, it should be appreciated that the disclosed system 100 may generally be utilized to control one or more components of a work vehicle having any suitable configuration.

As shown, the control system 100 includes a controller 102 configured to electronically control the operation of one or more components of the work vehicle 10, such as the various hydraulic components of the work vehicle 10 (e.g., the hydrostatic unit 28, the lift cylinder 50 and the tilt cylinder 52). In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as the method 200 described below with reference to FIG. 7. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

As shown in FIG. 6, the controller 102 may be communicatively coupled to various components for controlling the operation of the hydraulic pumps 38, 40 (and, thus, the drive motors 30, 32) of the hydrostatic drive unit 28. Specifically, the controller 102 is shown in the illustrated embodiment as being coupled to suitable components for controlling the operation of the first hydraulic pump 40 and the first drive motor 30, thereby allowing the controller 102 to electronically control the speed of the left-side wheels 12, 16. However, it should be appreciated that the controller 102 may also be communicatively coupled to similar components for controlling the operation of the second hydraulic pump 40 and the second drive motor 32, thereby allowing the controller 102 to electronically control the speed of the right-side wheels 14, 18.

As indicated above, the hydraulic pump 40 may be driven by the engine 26 and may be fluidly connected to the drive motor 30 via suitable fluid couplings 42 (e.g., hydraulic hoses). The drive motor 30 may, in turn, drive the left-side wheels 12, 16 of the vehicle 10. In several embodiments, the drive motor 30 may be configured as a fixed displacement motor while the hydraulic pump 40 may be configured as a variable displacement pump. Accordingly, to change the rotational speed of the motor 30 (and, thus, the rotational speed of the wheels 12, 16), the displacement of the hydraulic pump 40 may be varied by adjusting the position or angle of a swashplate (indicated by the arrow 108) of the pump 40, thereby adjusting the flow of hydraulic fluid to the motor 30.

To electronically control the displacement of the swashplate 108, the controller 102 may be commutatively coupled to suitable pressurize regulating valves 110, 112 (PRVs) (e.g., solenoid-activated valves) configured to regulate the pressure of hydraulic fluid supplied to a control piston 114 of the pump 40. Specifically, as shown schematically in FIG. 6, the controller 102 may be coupled to both a forward PRV 110 configured to regulate the pressure of the hydraulic fluid supplied to a forward chamber 116 of the control piston 114 and a reverse PRV 112 configured to regulate the pressure of the hydraulic fluid supplied to a reverse chamber 118 of the control position 116. By pressurizing the forward chamber 116, the swashplate 108 of the pump 40 may be displaced such that hydraulic fluid flows through the fluid loop defined by the hydrostatic drive unit 28 in a manner that causes the motor 30 to drive the wheels 12, 16 in the forward direction. Similarly, by pressurizing the reverse chamber 118, the swashplate 108 may be displaced such that hydraulic fluid flows through the fluid loop in a manner that causes the motor 30 to drive the wheels 12, 16 in the reverse direction.

As is generally understood, the current supplied to each PRV 110, 112 is directly proportional to the pressure supplied to its corresponding chamber 116, 118, the pressure difference of which is, in turn, directly proportional to the displacement of the swashplate 108. Thus, for example, by increasing the current command to the forward PRV 110 by a given amount, the pressure within the forward chamber 116 and, thus, the angle of the swashplate 108 may be increased by a proportional amount(s). As the angle of the swashplate 108 is increased, the flow of hydraulic fluid supplied to motor 30 is similarly increased, thereby resulting in an increase in the rotational speed of the wheels 12, 16 in the forward direction. A similar control strategy may be used to increase the rotational speed of the wheels 12, 16 in the reverse direction by increasing the current command supplied to the reverse PRV 112.

In addition, the controller 102 may be configured to similarly control the operation of the hydraulic lift and tilt cylinders 50, 52. For example, in several embodiments, the controller 102 may be commutatively coupled to suitable pressure regulating valves 120, 122 (PRVs) (e.g., solenoid-activated valves) configured to regulate the pressure of the hydraulic fluid supplied to each cylinder 50, 52. Specifically, as shown schematically in FIG. 6, the controller 102 may be coupled to both a lift PRV 120 configured to regulate the pressure of the hydraulic fluid supplied to the lift cylinder 50 and a tilt PRV 122 configured to regulate the pressure of the hydraulic fluid supplied to the tilt cylinder 52. In such an embodiment, the current supplied to each PRV 120, 122 may be directly proportional to the pressure supplied to its corresponding cylinder 50, 52, thereby allowing the controller 102 to control the displacement of each cylinder 50, 52 (and, thus, the height and/or tilt angle of the implement 48 relative to the driving surface 54. For example, by carefully regulating the current supplied to each PRV 120, 122, the controller 102 may be configured to control a displacement length 124 of a piston rod 126 of each cylinder 50, 52 as the rod 126 is extended and retracted with changes in the hydraulic pressure supplied to the cylinders 50, 52.

Additionally, as shown in FIG. 6, the controller 102 may be communicatively coupled to one or more sensors 140, 142, 144 for monitoring one or more tip-related parameters of the work vehicle 10. For instance, the controller 102 may be coupled to one or more load sensors 140 configured to monitor the load weight of any external loads added to the loader arms 44, 46 via the implement 48. In general, the load sensor(s) 140 may comprise any suitable sensing device(s) that allows the load weight to be monitored. For example, in one embodiment, the load sensor(s) 140 may comprise one or more pressure sensors 150 (FIGS. 1 and 2) in fluid communication with each lift cylinder 50 and/or each tilt cylinder 52 in order to generate a signal indicative of the fluid pressure in such cylinder(s) 50, 52. As the load weight increases, the hydraulic fluid pressure required to lift the implement 48 may correspondingly increase. Thus, by determining the correlation between the fluid pressure in the cylinders(s) 50, 52 and the weight of the external load(s), the measurement(s) provided by the pressure sensor(s) 150 may be utilized to estimate the load being applied to the loader arms 44, 46 via the implement 48 at any given instance.

It should be appreciated that the exact correlation between the fluid pressure and the load weight may generally depend on the particular configuration and arrangement of the loader arms 44, 46. However, it is well within the purview of one of ordinary skill in the art to determine such correlation based on the configuration/arrangement of the loader arms 44, 46. It should also be appreciated that, in alternative embodiments, the load sensors 140 may be located at any other suitable location on the work vehicle 10 and/or comprise any other suitable sensors capable of providing an indication of the load weight. For example, the load sensors 140 may comprise one or more pressure sensors in fluid communication with one or more of the suspension cylinders (not shown) of the vehicle's suspension to monitor the loads applied through the suspension. In another embodiment, the load sensors 140 may comprise one or more pressure sensors in fluid communication with one or of the tires of the work vehicle 10 to monitor tire pressure.

Additionally, as shown in FIG. 6, the controller 102 may be communicatively coupled to one or more height or position sensors 142 configured to monitor the height/position of the implement 48. In several embodiments, the position sensor(s) 142 may be configured to monitor the degree of actuation of the lift and/or tilt cylinders 50, 52, which may provide an indication of the position of the implement 48. For instance, the position sensor(s) 142 may comprise one or more rotary position sensors, linear position sensors and/or the like associated coupled to the piston rod(s) 126 or other movable components of the cylinders 50, 52 to monitor the travel distance of such components. In another embodiment, the position sensor(s) 142 may comprise one or more non-contact sensors, such as one or more proximity sensors, configured to monitor the change in position of such movable components of the cylinders 50, 52. In a further embodiment, the position sensor(s) may comprise one or more flow sensors configured to monitor the fluid into and/or out of each cylinder 50, 52, thereby providing an indication of the degree of actuation of such cylinder 50, 52 and, thus, the location of the implement 48.

In alternative embodiments, the position sensor(s) 142 may comprise any other suitable sensors that are configured to provide a measurement signal associated with the height/position of the implement 48. For example, in another embodiment, a transmitter may be coupled to the implement 48 or a portion of one of the loader arms 44, 46 that transmits a signal indicative of the height/position of the implement 48 to a receiver disposed at another location on the vehicle 10.

Moreover, the controller 102 may also be communicatively coupled to one or more inclination sensors 144 configured to monitor the angle of inclination 96 of the work vehicle 10. For example, in several embodiments, the inclination sensor(s) 144 may comprise one or more one or more accelerometers, gyroscopes and/or any other suitable tilt sensor(s) configured to monitor the angle of inclination 96 of the work vehicle 10 by measuring its orientation relative to gravity. For instance, as shown in FIG. 2, an inclination sensor(s) 144 is mounted to a portion of the chassis 20. However, in other embodiments, the inclination sensor(s) 144 may be disposed on the work vehicle 10 at any other suitable location.

It should be appreciated that, by monitoring both the load weight and the position of the external load, the controller 102 may be configured to calculate or determine the load moment arm 64 resulting from the external load. Specifically, as indicated above, the load moment arm 64 may be calculated by multiplying the load weight by the distance 74 (FIG. 2) defined between the front pivot point 58 and the load center of gravity 72. This calculated load moment arm 64, together with the vehicle moment arm 62, may then be utilized by the controller 102 to determine the location of the vehicle's combined center of gravity 60. Moreover, by monitoring the angle of inclination 96 of the work vehicle 10, the controller 102 may also be configured to adjust the location of the combined center of gravity 60 to account for any sloped or included driving surfaces 54.

By determining the location of the combined center of gravity 60, the controller 102 may be configured to actively monitor the tip-related state of the work vehicle 10, which may then be used as a basis for controlling its operation. For instance, as will be described below, when the controller 102 detects that the wok vehicle 10 is in a tipping state (e.g., when the combined center of gravity 60 is located on the non-vehicle side 89 of the forward tipping plane 76), the controller 102 may be configured to automatically control the operation of the drive motors 30, 32 and/or the lift/tilt cylinders 50, 52 in an attempt to counteract or reverse the tipping action of the vehicle 10. In addition, the controller 102 may be configured to provide the operator with a tip indicator associated with the tip-related condition of the work vehicle 10. For instance, in one embodiment, the controller 102 may be configured to cause a suitable warning light to be flashed or activated when the work vehicle 10 is close to tipping (e.g., when the tip percentage for the work vehicle 10 exceeds a given threshold). In another embodiment, the controller 102 may be configured to cause the calculated tip percentage to be displayed on a display device 128 of the work vehicle 10, thereby providing the operator with a direct visual indicator of the likelihood of the vehicle 10 tipping.

Figure 7:
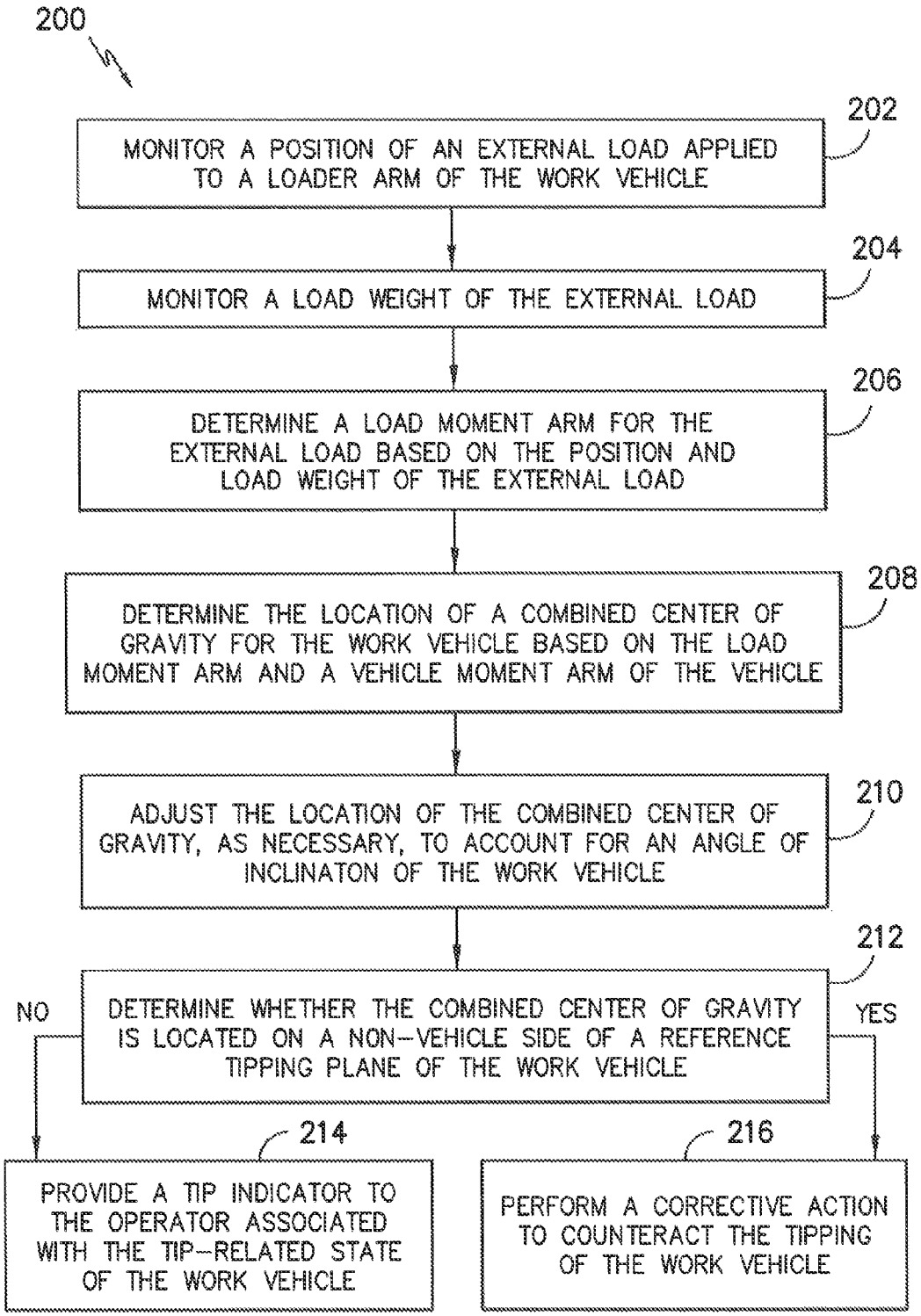
FIG. 7 illustrates a flow diagram of one embodiment of a method for controlling a work vehicle based on a monitored tip condition of the vehicle.

Referring now to FIG. 7, a flow diagram of one embodiment of a method 200 for controlling a work vehicle based on a monitored tip condition of the vehicle is illustrated in accordance with aspects of the present subject matter. In general, the method 200 will be described with reference to the work vehicle 10 and system 100 described above with reference to FIGS. 1-6. However, it should be appreciated by those of ordinary skill in the art that the disclosed method 200 may generally be utilized to control the operation of a work vehicle have any suitable configuration and being controlled by any suitable control system. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown, at (202), the method 200 includes monitoring a position of an external load applied to the loader arm(s) 44, 46 of the work vehicle 10. As indicated above, the external load may generally correspond to any suitable load applied through the loader arms 44, 46 via the implement 48 (e.g., when the bucket is full or otherwise loaded). Additionally, as indicated above, the system controller 102 may be configured to monitor the position of the external load by monitoring the position of the implement 48 using one or more suitable position sensors 142. The monitored position of the implement 48 may then be utilized to calculate or estimate the load center of gravity 72 for the external load.

It should be appreciated that, in addition to monitoring the position of the implement 48, the controller 102 may also be configured to transmit suitable control signals to a display device 128 (FIG. 6) located within the cab 22 to allow the position of the implement 48 to be displayed to the operator. For example, it may be desirable in many instances (e.g., when performing operations that require repeated raising and lowering of the implement 48 to a specific height) for the operator to know the exact height of the implement 48 relative to the driving surface 54. Thus, by displaying the position, the operator may be provided with a visual indicator that allows him/her to accurately verify the position of the implement 48.

Additionally, at (204), the method 200 includes monitoring a load weight of the external load applied through the loader arm(s) 44, 46. Specifically, as indicated above, the controller 102 may be configured to monitor the load weight using one or more suitable load sensors 140, such as one or more pressure sensors 150 configured to monitor the pressure within the one or more of the vehicle's hydraulic cylinders 50, 52.

It should be appreciated that, similar to the implement position, the controller 102 may be configured to transmit suitable control signals to a display device 128 (FIG. 6) located within the cab 18 to allow the load weight to be displayed to the operator. For example, it may be desirable in many instances (e.g., when performing operations that require repeated loading of a specific amount of material) for the operator to know the exact weight of the load being carried by the implement 48. Thus, by displaying the load weight, the operator may be provided with a visual indicator that allows him/her to accurately verify the weight of any external load applied through the loader arms 44, 46.

Referring still to FIG. 7, at (206), the method 200 includes determining a load moment arm 64 for the external load based on the monitored position and load weight of the external load. Specifically, as indicated above, the load moment arm 64 may be calculated by multiplying the load weight by the distance 74 defined between the pivot point 58 and the load center of gravity 72. Thus, by continuously monitoring the position of the implement 48, the location of the load center of gravity 72 may be determined and actively updated as the implement 48 is moved relative to the driving surface 54. The updated load center of gravity 72 may then be utilized together with the monitored load weight to determine the current load moment arm 65 acting on the work vehicle 10.

Additionally, at (208), the method 200 includes determining the location of a combined center of gravity 60 for the work vehicle 10 based on the load moment arm 64 and a vehicle moment arm 62 of the vehicle 10. Specifically, as indicated above, the vehicle moment arm 62 may be calculated based on the unloaded vehicle weight and the vehicle center of gravity 66, both of which may be known based on the configuration of the work vehicle 10 and may be stored within the controller's memory 106. Thus, using the calculated load moment arm 64 and the stored vehicle moment arm 62, the location of the vehicle's combined center of gravity 60 may be determined at any given instance during vehicle operation.

Moreover, at (210), the method 200 includes adjusting the location of the combined center of gravity 60, as necessary, to account for the angle of inclination 96 of the work vehicle 10. Specifically, as indicated above, when the work vehicle 10 is located on a sloped driving surface 54, the combined center of gravity 60 may shift forward, backwards or sideways depending on the vehicle's angle of inclination 96. Thus, by monitoring such angle 96 (e.g., via the inclination sensor(s) 144), the controller 102 may be configured to adjust the location of the combined center of gravity 60 to account for sloped driving surfaces 54.

Referring still to FIG. 7, at (212), the method 200 includes determining whether the combined center of gravity 60 is located on the non-vehicle side 80 of a reference tipping plane 76, 84, 88 of the work vehicle 10. Specifically, as indicated above, when the combined center of gravity 60 is located on the vehicle side 78 of the vehicle's reference tipping planes 76, 84, 88, the work vehicle 10 may be in a stable, non-tipping state. However, if the combined center of gravity 60 shifts to the non-vehicle side 80 of one of the reference tipping planes 76, 84, 88, the work vehicle 10 may be in a non-tipping state and, thus, may begin tipping about the pivot point defined at such reference tipping plane.

As shown in FIG. 7, when the combined center of gravity 60 is located on the vehicle side 78 of the reference tipping planes 76, 84, 88 such that the work vehicle 10 is in a stable, non-tipping state, the method 200 includes, at (214) providing a tip indicator to the operator associated with the tip-related state of the work vehicle 10. Specifically, in several embodiments, the controller 102 may be configured to transmit suitable control signals to provide the operator with a warning that that work vehicle 10 is close to tipping (e.g., when the tip percentage for the vehicle 10 exceeds a given threshold, such as 90%). It should be appreciated that the warning may be a visual warning (e.g., by flashing or turning on a warning light or by displaying a textual message to the operator via the display device 128 (FIG. 6)), an audible warning and/or any other suitable type of warning that can provide the operator with information related to the tip-related state of the work vehicle 10.

Alternatively, the tip indicator may correspond to a visual readout of the tip percentage of the work vehicle 10. For example, as indicated above, the controller 102 may be configured to calculate the tip percentage based on the horizontal positioning of the combined center of gravity 60 relative to front pivot point 58. The controller 102 may then be configured to transmit suitable control signals to the display device 128 (FIG. 6) of the work vehicle 10 to allow the calculated tip percentage to be displayed to the operator. As such, the operator may be provided with a direct visual indication of the likelihood of the vehicle tipping.

It should be appreciated that, by providing the tip indicator to the operator (regardless of its type or form), the operator may be able to take any suitable corrective action deemed necessary to reduce the likelihood of the vehicle tipping. For instance, the operator may provide suitable operator inputs instructing the controller 102 to adjust the speed and/or acceleration of the work vehicle 10, to vary the position of the implement 48, to steer the work vehicle 10 in a given direction and/or to perform any other suitable action that may assist in reducing the likelihood of the vehicle tipping. As indicated above, the controller 102 may be configured to implement such corrective actions by electronically controlling the operation of the various components of the work vehicle 10, such as the drive motors 30, 32, the lift cylinders 40 and/or the tilt cylinders 52.

Referring still to FIG. 7, when the combined center of gravity 60 is located on the non-vehicle side 80 of one of the reference tipping planes 76, 84, 88 such that the work vehicle 10 is in a tipping state, the method 200 includes, at (216), automatically performing a corrective action to counteract or reverse the actual tipping of the vehicle 10. Specifically, in several embodiments, the controller 102 may be configured to automatically control the operation of the drive motors 30, 32 and/or the lift/tilt cylinders 50, 52 when the work vehicle 10 begins to tip in an attempt to stop or reverse such tipping.

For instance, in one embodiment, the controller 102 may be configured to simultaneously control the drive motors 30, 32 and the tilt/lift cylinders 50, 52 so that the work vehicle 10 is driven in the tipping direction while the implement 48 is being lowered. Thus, for example, if the work vehicle 10 is beginning to tip forward about the pivot point 58 defined at the front tires 12, 14, the controller 102 may be configured to control the drive motors 30, 32 in a manner that increases the vehicle's speed and/or acceleration in the forward direction while simultaneously controlling the lift/tilt cylinders 50, 52 to lower the position of the external load, thereby allowing the vehicle 10 to be returned to a stable, non-tipping state. Similarly, if the work vehicle 10 is located on a sideways sloped driving surface 54 and begins to tip to one of its sides, the controller 102 may be configured to control the drive motors 50, 52 in a manner that turns the vehicle 10 in the sideways tipping direction (e.g., by driving the uphill tires in a forward direction and the downhill tires in a reverse direction) while simultaneously controlling the lift/tilt cylinders 50, 52 to lower the position of the external load.

In other embodiments, the controller 102 may simply be configured to lower the position of the implement 48 in order to counteract or reverse vehicle tipping. For instance, when the work vehicle 10 is driving forward at its maximum ground speed, the controller 102 will not be able to increase the speed and/or acceleration of the vehicle 10 in the forward direction. In such instance, the operation of the tilt/lift cylinders 50, 52 may be controlled to lower the implement 48 in an attempt to reverse vehicle tipping.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for controlling a work vehicle based on a monitored tip condition of the work vehicle, the method comprising:

determining, with a computing device, a location of a combined center of gravity for the work vehicle based at least in part on an external load applied to a loader arm of the work vehicle;

determining a tip-related state of the work vehicle based on the location of the combined center of gravity relative to a pivot point defined between a tire of the work vehicle and a driving surface for the work vehicle, wherein the work vehicle is in a non-tipping state when the combined center of gravity is located on a vehicle side of the pivot point and in a tipping state when the combined center of gravity is located on a non-vehicle side of the pivot point; and controlling a drive motor of the work vehicle such that a speed or an acceleration of the work vehicle is increased in a tipping direction of the work vehicle when it is determined that the work vehicle is in the tipping state.

2. The method of claim 1, wherein determining a location of a combined center of gravity for the work vehicle comprises:

determining a load moment arm for the external load; and determining the location of the combined center of gravity based on the load moment arm and a vehicle moment arm for the work vehicle.

3. The method of claim 2, wherein determining a load moment arm for the external load comprises:

monitoring, with a load sensor coupled to the computing device, a load weight of the external load;

monitoring, with a position sensor coupled to the computing device, a position of the external load; and determining the load moment arm based on the load weight and the position of the external load.

4. The method of claim 1, further comprising monitoring an angle of inclination of the work vehicle.

5. The method of claim 4, further comprising adjusting the location of the combined center of gravity based on the angle of inclination.

6. The method of claim 1, wherein automatically performing a correction action to counteract vehicle tipping comprises controlling a hydraulic cylinder of the work vehicle to lower the external load when it is determined that the work vehicle is in the tipping state.

7. The method of claim 1, further comprising providing a tip indicator associated with the tip-related state of the work vehicle.

8. The method of claim 1, wherein the tip indicator comprises at least one of an operator warning or a visual readout of a tip percentage of the work vehicle.

9. The method of claim 8, wherein the tip percentage provides an indication of the likelihood of the work vehicle transitioning from the non-tipping state to the tipping state.

10. A system for controlling a work vehicle based on a monitored tip condition of the work vehicle, the system comprising:

a computing device including a processor and associated memory, the memory storing computer-readable instructions that, when implemented by the processor, configure the computing device to:

determine a location of a combined center of gravity for the work vehicle based at least in part on an external load applied to a loader arm of the work vehicle;

determine a tip-related state of the work vehicle based on the location of the combined center of gravity relative to a pivot point defined between a tire of the work vehicle and a driving surface for the work vehicle, wherein the work vehicle is in a non-tipping state when the combined center of gravity is located on a vehicle side of the pivot point and in a tipping state when the combined center of gravity is located on a non-vehicle side of the pivot point; and control a drive motor of the work vehicle such that a speed or an acceleration of the work vehicle is increased in a tipping direction of the work vehicle when it is determined that the work vehicle is in the tipping state.

11. The system of claim 10, wherein the computing device is further configured to determine a load moment arm for the external load, wherein the location of the combined center of gravity is determined by the computing device based on the load moment arm and a vehicle moment arm for the work vehicle.

12. The system of claim 11, further comprising a load sensor coupled to the computing device for monitoring a load weight of the external load and a position sensor coupled to the computing device for monitoring a position of the external load, wherein the computing device is configured to determine the load moment arm based on the load weight and the position of the external load.

13. The system of claim 10, further comprising an inclination sensor coupled to the computing device for monitoring an angle of inclination of the work vehicle, the computing device being configured to adjust the location of the combined center of gravity based on the angle of inclination.

14. The system of claim 10, wherein the corrective action comprises controlling a hydraulic cylinder of the work vehicle to lower the external load.

15. The system of claim 10, wherein the computing device is further configured to provide a tip indicator associated with the tip-related state of the work vehicle.

16. The system of claim 15, wherein the tip indicator comprises at least one of an operator warning or a visual readout of a tip percentage of the work vehicle.

* * * * *